US005855120A

United States Patent [19]

Kim

[11] Patent Number: 5,855,120

[45] Date of Patent: Jan. 5, 1999

[54] METHOD AND APPARATUS FOR DRIVING PUMP MOTOR FOR REFRIGERATOR DISPENSER

[75] Inventor: Jae Ho Kim, Kyungsangnam-Do, Rep. of Korea

[73] Assignee: LG Electronics Inc., Rep. of Korea

[21] Appl. No.: 926,896

[22] Filed: Sep. 10, 1997

Related U.S. Application Data

[62] Division of Ser. No. 770,805, Dec. 20, 1996, abandoned.

[30] Foreign Application Priority Data

Dec. 21, 1995 [KR] Rep. of Korea ..... 53437
Dec. 21, 1995 [KR] Rep. of Korea ..... 53439

[51] Int. Cl.[6] ..... B67D 5/62

[52] U.S. Cl. ..... 62/389; 417/12

[58] Field of Search ..... 222/110, 318; 62/389; 417/12, 290

[56] References Cited

U.S. PATENT DOCUMENTS 3,773,303 11/1973 Griffith ..... 222/424
4,041,944 8/1977 Rhodes ..... 128/214 B
5,120,199 6/1992 Youngs et al. ..... 417/12
5,228,594 7/1993 Aslin ..... 222/63

*Primary Examiner*—William E. Tapolcai
*Attorney, Agent, or Firm*—Ostrolenk, Faber, Gerb & Soffen, LLP

[57] ABSTRACT

An improved method and an apparatus for driving a pump motor for a refrigerator dispenser which are capable of feeding-back a water remaining in a discharge hose to a water container of the refrigerator by reversely rotating a pump motor after discharging the water from the water container, for thus preventing the water and the discharge hose from being polluted. The method includes the step of a first step for discharging a water from a water container through a discharge hose by driving a pump motor when a lever switch is turned on, a second step for stopping the operation of the pump motor when the lever switch is turned off and finishing the water discharge, and a third step for feeding back the water remaining in the discharge hose to a water container of the refrigerator after a predetermined time after the second step by reversely rotating the pump motor with respect to the rotation direction of the pump motor in the first step.

1 Claim, 6 Drawing Sheets

METHOD AND APPARATUS FOR DRIVING PUMP MOTOR FOR REFRIGERATOR DISPENSER

This is a Division of application Ser. No. 08/770,805, filed Dec. 20, 1996, now abandoned.

BACKGROUND OF THE INVENTION

1. Field of the Invention

The present invention relates to a method and an apparatus for driving a pump motor for a refrigerator dispenser, and in particular to an improved method and an apparatus for driving a pump motor for a refrigerator dispenser which are capable of feeding-back a water remaining in a discharge hose to a water container of the refrigerator by reversely rotating a pump motor after discharging the water from the water container, for thus preventing the water and the discharge hose from being polluted.

2. Description of the Conventional Art

FIG. 1 is a cross-sectional diagram illustrating a dispenser having a conventional pump motor.

As shown therein, when a lever 7 is inwardly pushed by a user by using a cup (not shown) or the like, a lever switch 5 is turned on, and a pump motor 1 is driven, so that water is discharged to the outside through a discharge hose 2 and a discharge outlet 6.

Here, foreign substances contained in the water are filtered by a filter 4.

The watering level of the cup is checked by the user. When the water level exceeds a predetermined level, the cup is removed from the dispenser position, and then the lever switch 5 is turned off, and the pump motor 1 stops, for thus finishing the discharge of the water from the refrigerator.

However, the water pumped by the pump motor 1 remains in the discharge hose 2. If the user does not use the water dispenser for long time, the water in the discharge hose 2 may be polluted.

In addition, the foreign substances filtered by the filter when the water is pumped are attached to the surface of the filter. The thusly attached foreign substances may remain in the filter. As the water pumping is repeatedly performed, the amount of the foreign substances attached to the filter is increased. Therefore, the amount of the pumped water is decreased due to the foreign substances. In addition, when the amount of the foreign substances are further increased, the water may be blocked thereby, for thus causing an operational problem of the system.

Furthermore, during the discharge of the water, the user must check the watering level of the cup. If the lever is mistakenly pressed for longer time, the water may be over-flown beyond the limit of the cup.

SUMMARY OF THE INVENTION

Accordingly, it is an object of the present invention to provide a method and an apparatus for driving a pump motor for a refrigerator dispenser which overcome the problems encountered in the conventional art.

It is another object of the present invention to provide a method and an apparatus for driving a pump motor for a refrigerator dispenser which are capable of reversely driving a pump motor with respect to the driving direction when the pump motor is rotated when pumping the water after the water is discharged, for thus feeding-back the water remaining in a hose into a water container of the refrigerator.

It is another object of the present invention to provide a method and an apparatus for driving a pump motor for a refrigerator dispenser which are capable of previously setting various modes in accordance with the amount of water being discharged, and discharging water by a predetermined amount by selecting one mode.

To achieve the above objects, in accordance with a first embodiment of the present invention, there is provided an apparatus for driving a pump motor for a refrigerator dispenser which includes the steps of a first step for discharging a water from a water container through a discharge hose by driving a pump motor when a lever switch is turned on, a second step for stopping the operation of the pump motor when the lever switch is turned off and finishing the water discharge, and a third step for feeding back the water remaining in the discharge hose to a water container of the refrigerator after a predetermined time after the second step by reversely rotating the pump motor with respect to the rotation direction of the pump motor in the first step.

To achieve the above objects, in accordance with a second embodiment of the present invention, there is provided an apparatus for driving a pump motor for a refrigerator dispenser which includes the steps of a first step for setting a plurality of modes corresponding to the time when a pump motor is driven, a second step for selecting one from the modes, a third step for counting a driving time of the pump motor after the pump motor is operated, and a fourth step for finishing a water discharging operation.

To achieve the above objects, there is provided a method for driving a pump motor for a refrigerator dispenser which includes a pump motor, a switch unit for outputting a normal rotation switch signal and a reverse rotation switch signal in accordance with an operation of a lever, a microprocessor for discharging a water remaining in a water container of the refrigerator to the outside through a discharge hose by driving the pump motor in accordance with the normal rotation switch signal applied thereto and for outputting a reverse rotation driving signal after counting a predetermined time lapse when the reverse rotation switch signal is inputted, a normal rotation driving unit for driving the pump motor in the direction in order for the water to be discharged to the outside in accordance with the normal rotation driving signal from the microprocessor, and a reverse rotation driving unit for reversely driving the pump motor with respect to the normal direction in accordance with the reverse driving signal from the microprocessor.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 2:
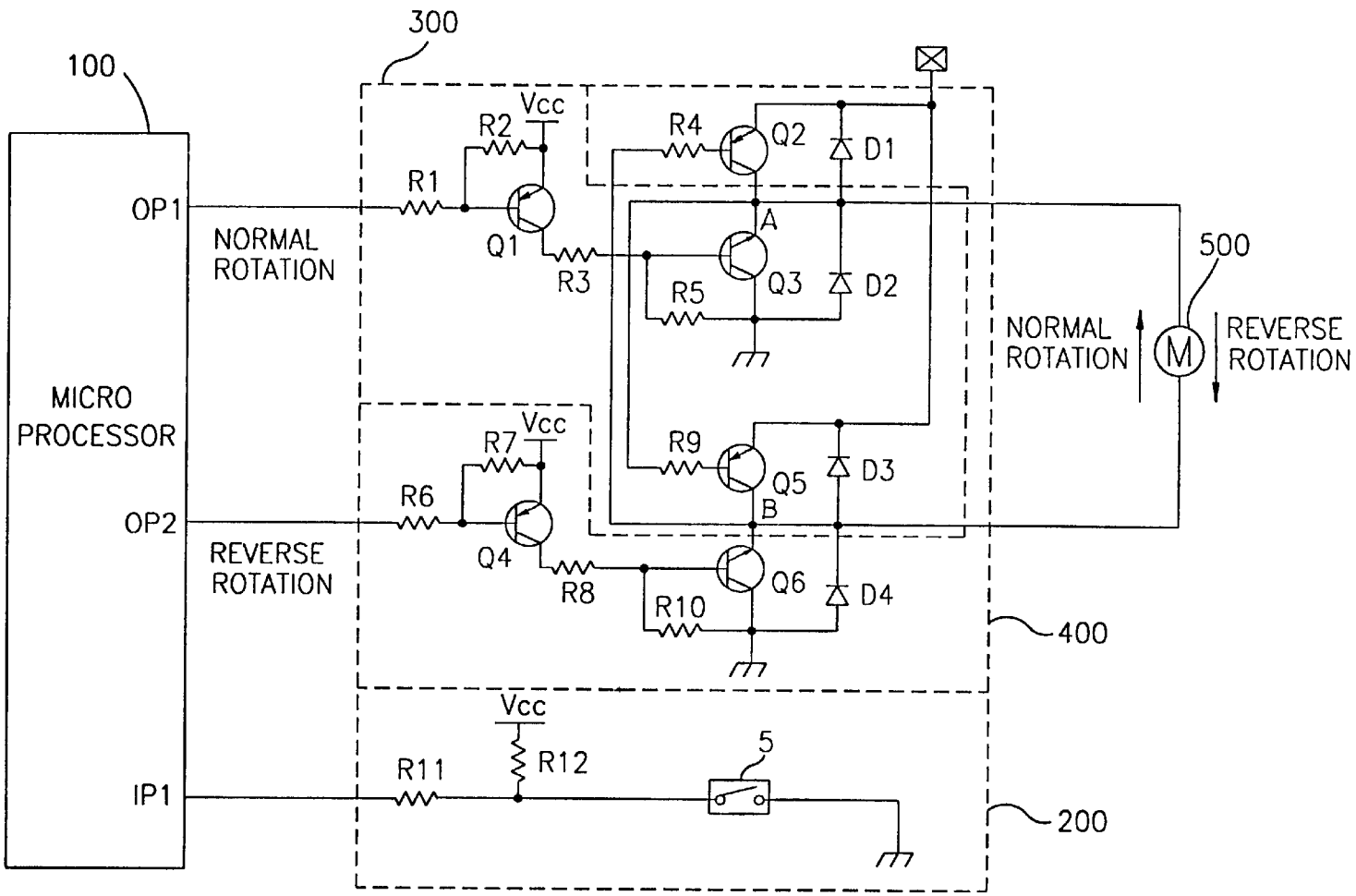
FIG. 2 is a circuit diagram illustrating a driving apparatus for a pump motor used in a refrigerator dispenser according to a first embodiment of the present invention.

FIG. 2 is a circuit diagram illustrating a driving apparatus for a pump motor used in a refrigerator dispenser according to a first embodiment of the present invention.

As shown therein, the driving apparatus for a pump motor according to the present invention includes a pump motor 500, a switching unit 200 having a lever switch 5, a microprocessor 100 for determining whether or not to output a normal rotation signal in accordance with the operation of the lever switch 5 and for outputting a reverse driving signal for a predetermined time after the normal rotation driving signal is outputted, a normal rotation driving unit 300 for normally driving the pump motor when the normal driving signal is outputted from the microprocessor 100, and a reverse rotation driving unit 400 for reversely driving the pump motor 500 when the reverse rotation driving signal is outputted from the microprocessor 100.

When a user inwardly pushes the lever by using a cup or he like, the lever switch 5 is turned on in step S31.

Therefore, a low level signal is applied to an input terminal P1 of the microprocessor 100, and the microprocessor 100 outputs a low level signal to an output terminal OP1, and a high level signal is outputted to an output terminal OP2.

A transistor Q1 is turned on in accordance with a low level signal from the output terminal OP1, and a high level signal is applied to the base of a transistor Q3, and a point "A" becomes a ground level. In addition, since the ground level and the base of a transistor Q5 are connected to each other, the transistor Q5 is turned on.

Therefore, the current path is the transistor Q5 43> a point "B" 43> the pump motor 500 43> the point "A" 43> the transistor Q3. Therefore, the pump motor 500 is normally rotated in step S32.

During the operation of the pump motor 500, when the user removes the cup from the dispenser position, the lever switch 5 is turned off, and a high level signal is applied to the input terminal P1 of the microprocessor in step S33.

The microprocessor 100 converts the low level signal from the output terminal OP1 into a high level signal, so that the pump motor 500 is stopped in step S34.

In addition, on the assumption that time until the pump motor 500 is stopped is "a", the time "a" is previously set in the microprocessor 100.

The microprocessor 100 judges whether the time "a" lapsed in step S35. If the time "a" lapsed, the high level signal applied to the output terminal OP2 is converted into a low level signal. The reverse rotation driving unit 400 reversely rotates the pump motor 500, for thus feeding back the water remaining in the discharge hose to the water container of the refrigerator in step S36.

Namely, a transistor Q4 is turned on in accordance with the low level signal from the output terminal OP2, and a high level signal is applied to the base of the transistor Q6, and the point "B" becomes a ground level. Since the ground level and the base of the transistor Q2 are connected to each other, the transistor Q2 is turned on. Therefore, the current path is the transistor Q2 43> the point "A" 43> the pump motor 500 43> the point "B" 43> the transistor Q6.

On the assumption that the time until the water remaining in the hose is fed-back to the water container is "b", the time "b" is previously set in the microprocessor 100 as follows.

The table below illustrates various states based on the operation order of the pump motor.

| Operation state | | Normal rotation | Stop | Reverse rotation | Stop |
|---|---|---|---|---|---|
| Output port | OP1 | 0 | 1 | 1 | 1 |
| | OP2 | 1 | 1 | 0 | 1 |
| Lever switch 5 | | ON | OFF | OFF | OFF |
| Operation time of pump motor | | Determined by switch 5 | a | b | a |

The microprocessor 100 judges whether the time "b" lapsed in step S37. If the time "b" lapsed, the low level signal from the reverse rotation driving unit 400 is converted into a high level signal, and the pump motor 500 is stopped in step S38.

The operation is finished.

Therefore, the water remaining in the hose is fed-back to the water container of the refrigerator, for thus preventing the water the hose from being polluted.

In addition, the foreign substances attached to one side of the filter is removed by the feeding-back water.

Figure 4:
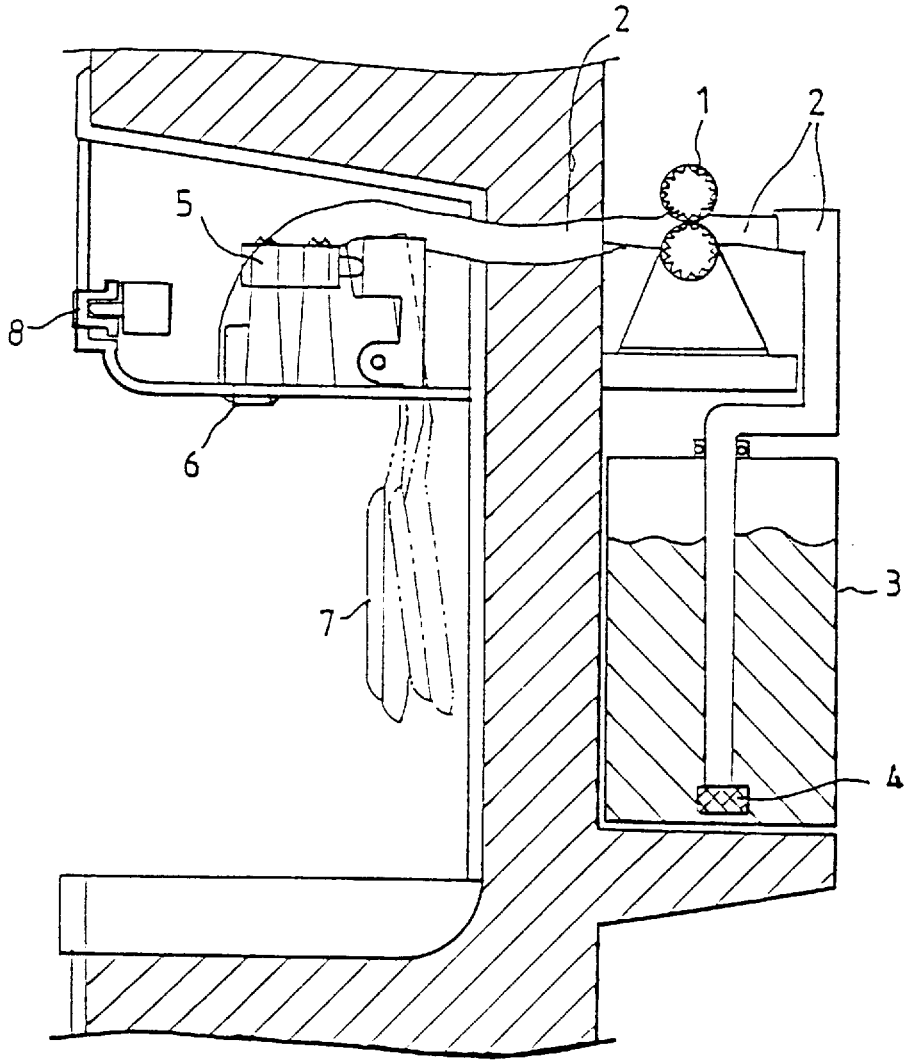
FIG. 4 is a cross-sectional diagram illustrating a dispenser having a pump motor according to the present invention.

FIG. 4 is a cross-sectional diagram illustrating a dispenser having a pump motor according to the present invention.

Figure 1:
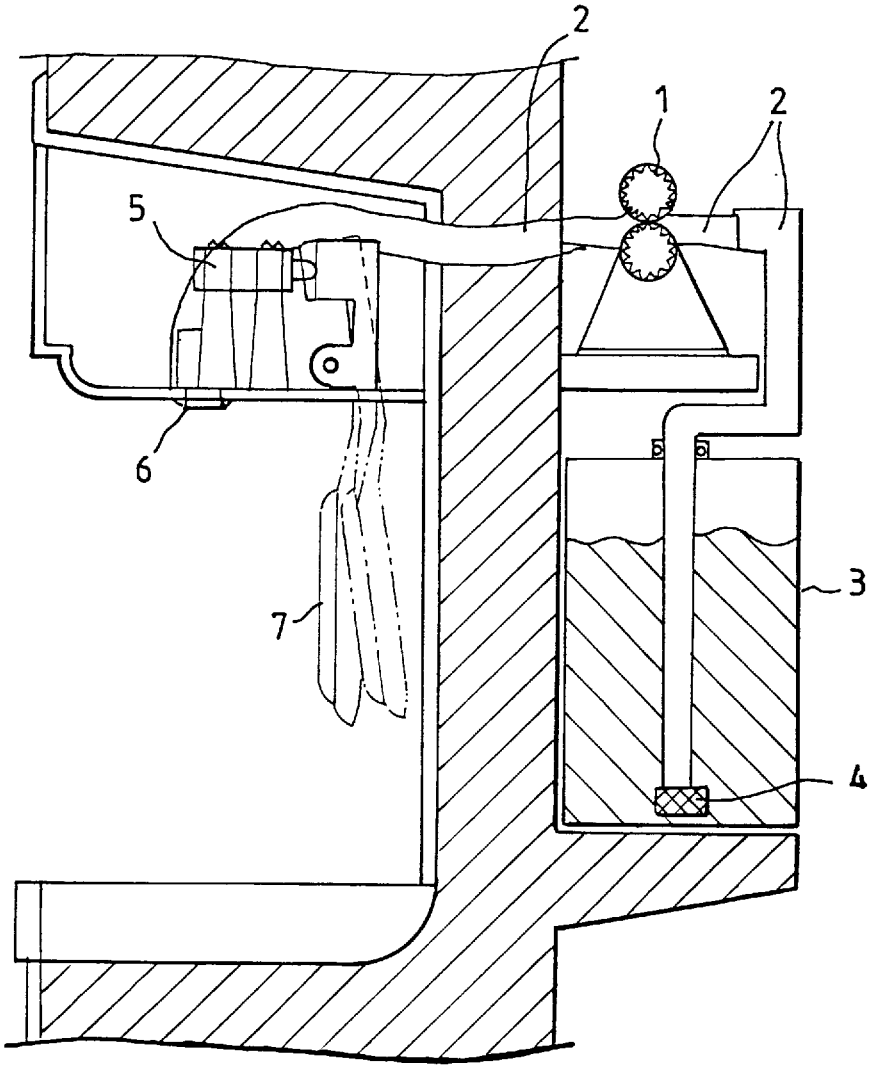
FIG. 1 CONVENTIONAL ART
FIG. 1 is a cross-sectional diagram illustrating a dispenser having a conventional pump motor.

As shown in therein, a control switch 8 is further provided compared to a first embodiment as shown in FIG. 1. The control switch 8 is disposed in a proper position of the dispenser for easier usage.

Figure 5:
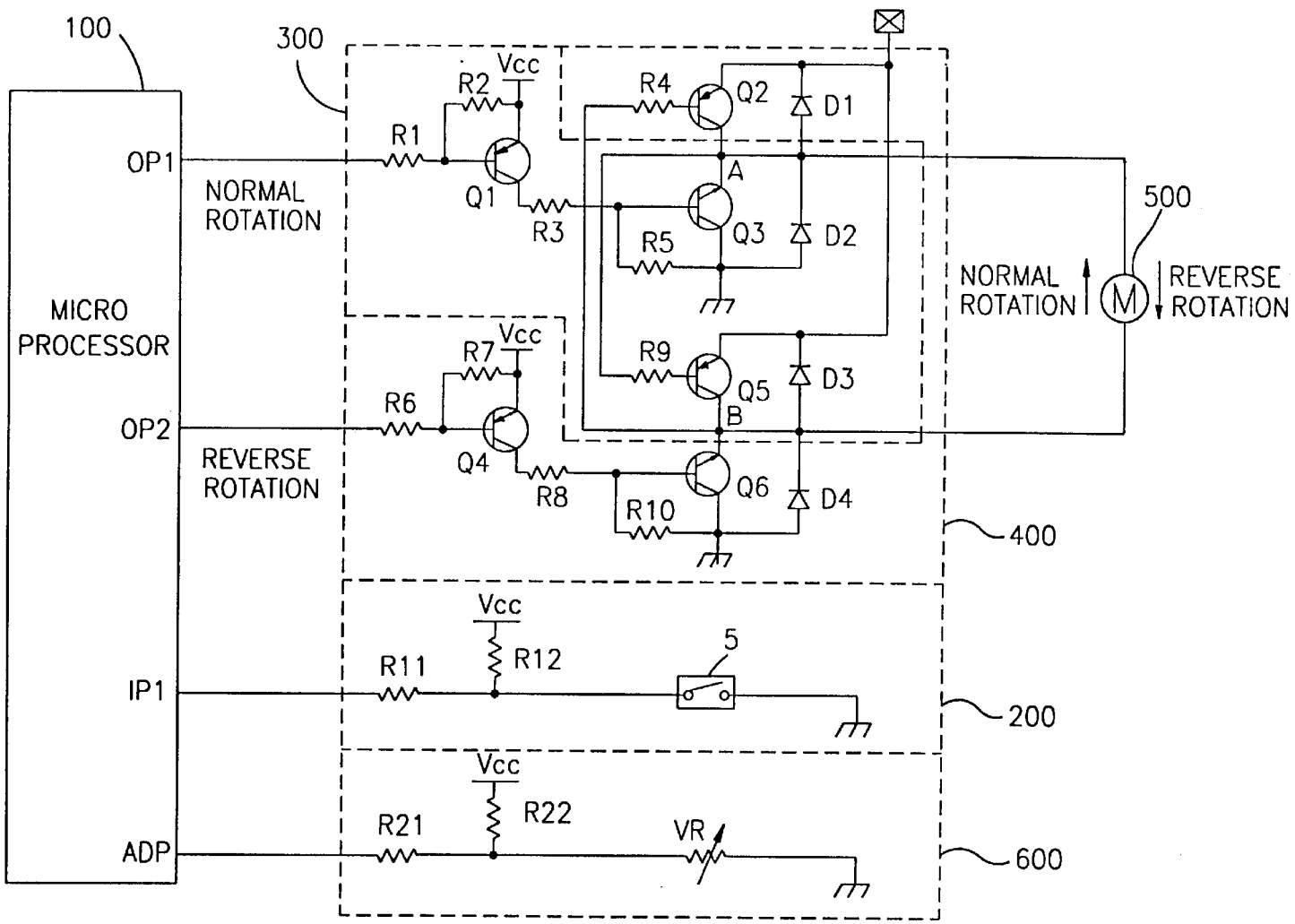
FIG. 5 is a circuit diagram illustrating a driving apparatus for a pump motor used in a refrigerator dispenser according to a second embodiment of the present invention.
Figure 6:
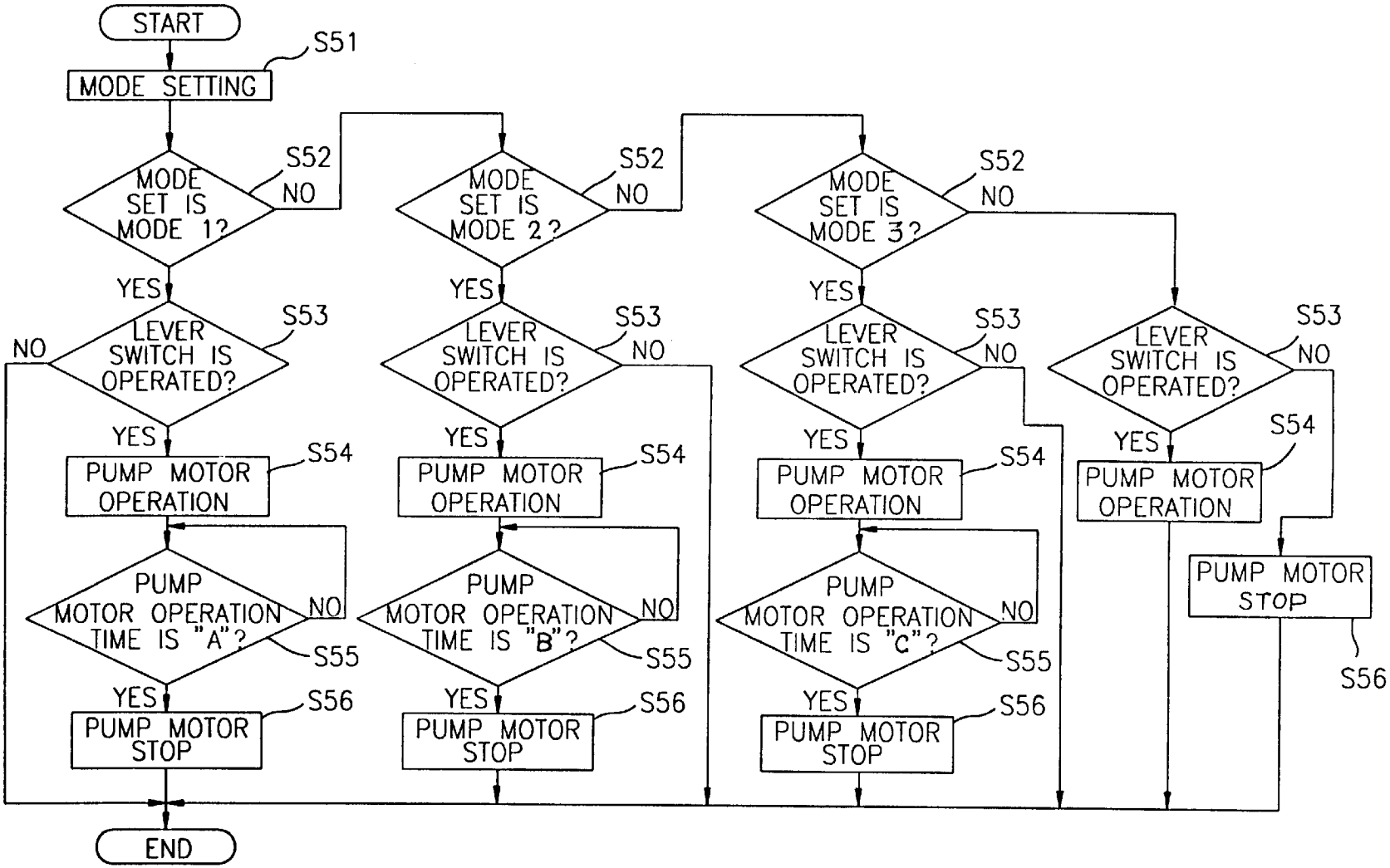
FIG. 6 is a flow chart of a driving method for a pump motor of FIG. 5 according to the present invention.

FIG. 5 is a circuit diagram illustrating a driving apparatus for a pump motor for a pump motor used in a refrigerator dispenser according to a second embodiment of the present invention.

Figure 3:
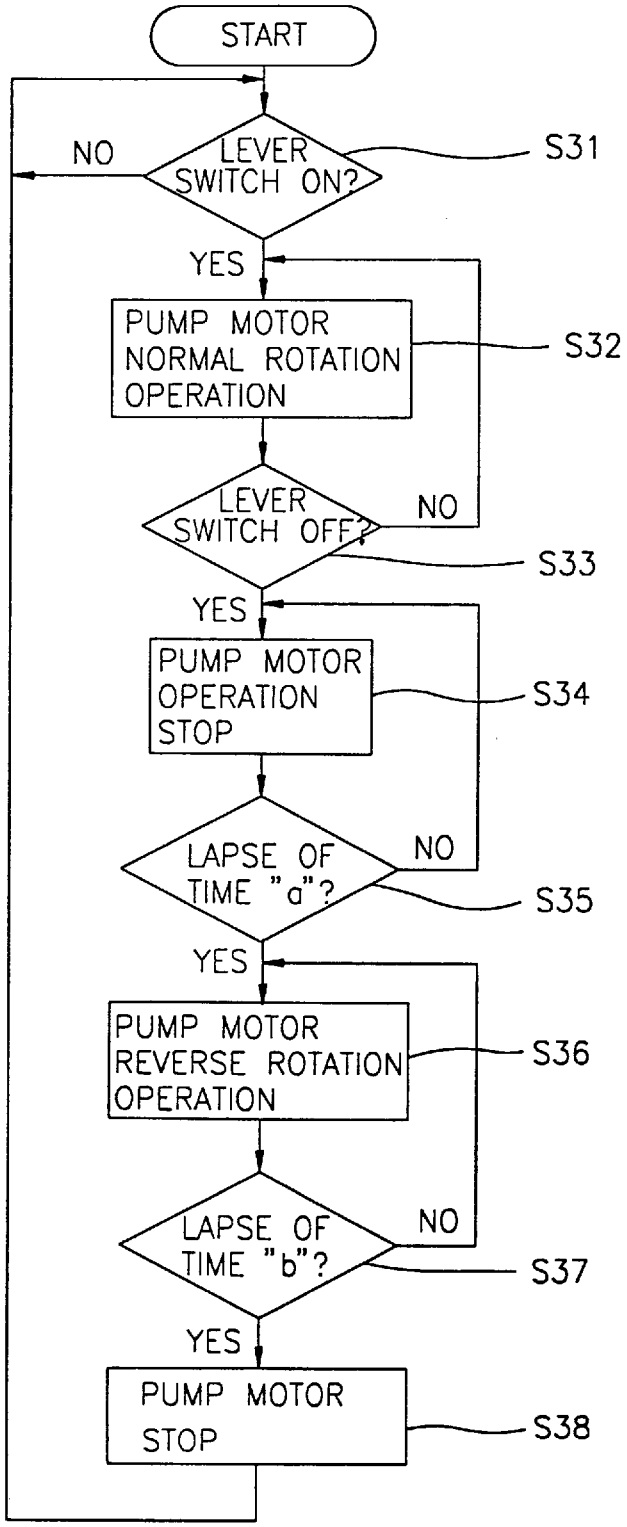
FIG. 3 is a flow chart of a driving method for a pump motor according to the present invention.

In this embodiment, a mode selecting unit having a variable resistor VR is further provided compared to the embodiment as shown in FIG. 3. The resistance value of the variable resistor VR is changed in accordance with the operation of the control switch 8.

The operation of the method and apparatus for driving a pump motor for a refrigerator dispenser according to a second embodiment of the present invention will now be explained with reference to the accompanying drawings.

When the user presses the control switch 8, the resistance value of the variable resistor VR is changed. The voltage Vcc is divided by the variable resistor VR, a full-up resistor R22, and a current limitation resistor R21 and is inputted to the input terminal ADP of the microprocessor 100. The microprocessor 100 sets a plurality of time modes in accordance with the level of the voltage supplied thereto, during which the pump motor is driven as shown in Table below.

| Item Mode | 1 | 2 | 3 | 4 |
|---|---|---|---|---|
| The level of voltage supplied to the input terminal ADP [V] | below 2 | 2~3 | 3~4 | above 4 |
| Driving time of pump motor | A | B | C | Determined based on the lever switch 5 |
| The amount of water discharged [cc] | 100 | 150 | 200 | Determined based on the lever switch 5 |

When the value of the voltage supplied to the input terminal ADP is 2~3v, the microprocessor 100 sets the driving time of the pump motor as "B".

In a state that the mode is set, the processes that the user inwardly presses the lever 7 by using a cup or the like and the pump motor 500 is driven are the same as the first embodiment of the present invention.

During the operation of the pump motor 500, the microprocessor 100 checks the time lapse after the pump motor is driven. If the time checked is a previously set pump motor driving time in step S55, the low level signal applied to the output terminal OP1 is converted into a high level signal, and the pump motor 500 is stopped in step S56.

In addition, if the value of the voltage inputted to the input terminal ADP is above 4v, the microprocessor 100 does not set the driving time of the pump motor. Therefore, the amount of water being discharged is determined based on the operation of the lever switch 5.

Thereafter, the pump motor is reversely rotated, for thus feeding-back the water remained in the hose to the water container of the refrigerator.

As described above, the method and apparatus for driving a pump motor for a refrigerator dispenser according to the present invention is basically directed to accurately discharging the water from the dispenser of the refrigerator, for thus preventing an over-flow of the water beyond the limit of a cup or the like.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An apparatus for driving a pump motor for a refrigerator dispenser, comprising:

a pump motor;

a switching unit for outputting a normal rotation switch signal and a reverse rotation switch signal in accordance with an operation of a lever;

a microprocessor for discharging water remaining in a water container of the refrigerator outside the water container through a discharge hose by driving the pump motor in accordance with the normal rotation switch signal applied thereto and for outputting a reverse rotation driving signal after counting a predetermined time lapse when the reverse rotation switch signal is inputted;

a normal rotation driving unit for driving the pump motor in the direction in order for the water to be discharged to the outside in accordance with the normal rotation driving signal from the microprocessor;

a reverse rotation driving unit for reversely driving the pump motor with respect to the normal direction in accordance with the reverse driving signal from the microprocessor; and a mode selecting unit for outputting a mode signal in accordance with an operation of a user, wherein microprocessor sets an operation time of the pump motor when the mode signal from the mode selector is inputted, outputs a normal rotation driving signal after a lapse of the operation time set, and stops the operation of the pump motor.

* * * * *